US005753762A

United States Patent [19]

Leuckx et al.

[11] Patent Number: 5,753,762

[45] Date of Patent: May 19, 1998

[54] POLYPORPYLENE FIBERS

[75] Inventors: Daniel Leuckx, Kester; Etienne de Wergifosse, Bouge, both of Belgium; René F. Venneman, Carimate, Italy

[73] Assignee: Fina Research, S.A., Feluy, Belgium

[21] Appl. No.: 798,008

[22] Filed: Feb. 12, 1997

[30] Foreign Application Priority Data

Feb. 12, 1996 [EP] European Pat. Off. ..... 96102002

[51] Int. Cl.[6] ..... C08L 23/12

[52] U.S. Cl. ..... 525/240; 525/322

[58] Field of Search ..... 525/240, 322

[56] References Cited

U.S. PATENT DOCUMENTS 5,478,646 12/1995 Asanuma et al. ..... 428/364

5,521,251 5/1996 Satoh et al. ..... 525/240

5,603,696 2/1997 Williams et al. ..... 604/93

FOREIGN PATENT DOCUMENTS 0414047 8/1990 European Pat. Off. .

0634505 1/1995 European Pat. Off. .

*Primary Examiner*—David W. Wu

*Attorney, Agent, or Firm*—Jimmy D. Wheelington; M. Norwood Cheairs

[57] ABSTRACT

The present invention relates to polypropylene fibers and nonwoven fabrics produced from spunlaid or staple fibers having improved natural bulk. Said polypropylene fibers are made of a blend of sPP and iPP.

5 Claims, No Drawings

POLYPORPYLENE FIBERS

BACKGROUND OF THE INVENTION

1. Field of the Invention

The present invention relates to polypropylene fibers and nonwoven fabrics produced from spunlaid or staple fibers having improved natural bulk. The present invention also concerns fibers which allow thermalbonding at lower temperature, and having finally an improved "Hand" which is the perception of the smoothness of the fabric.

2. Description of the Prior Art

Polypropylene has found significant use as a fiber and in yarn, for many years, particularly nonwovens. The polymer typically used for such fiber applications has been the isotactic crystalline homopolymer of propylene (referred to as "iPP").

However spunlaid nonwovens suffer from a lack of smoothness and covering power or bulk. The lack of bulk is detrimental for the nonwovens appearance, and its "covering power". This is particularly true for spunlaid nonwovens where the fibers do not undergo any crimping or texturizing treatment before thermal bonding, as is the case in nonwovens produced from (cut) carded staple fibers. Furthermore, a more bulky nonwoven allows a weight reduction of the web, still offering good appearance and covering power.

In the past many attempts have been made to improve these properties by for instance developing alternative structures comprising one layer spunlaid, one layer melt-blown and one layer spunlaid, or still by adding a further mechanical crimping to the fibers before performing thermalbonding.

We also noted that in U.S. Pat. No. 5,418,045 to Kimberley Clark it is taught that crimping of fibers may be improved and therefore the covering power, by the coextrusion of a blend polypropylene and SEBS.

However all these solutions involved heavy treatments or additional operations, and therefore are not very convenient.

A different form of crystalline, high molecular weight polypropylene currently receiving significant attention is identified as syndiotactic polypropylene (referred to as "sPP") although this type of polyolefin was first disclosed by Natta et al. in U.S. Pat. No. 3,258,455, commercially valuable forms of sPP are produced using members of a family of catalysts known as metallocene catalysts. Metallocene or homogeneous catalysts, which are suitable for the manufacture of sPP, have been developed more recently, as disclosed by FINA Technology Inc. (e.g. U.S. Pat. No. 4,794,096), W. Kaminsky and others.

A specific disclosure of the use of sPP in fiber applications appears in European Patent Application EP 0 414 047 (A. Tadashi, et al.). Tadashi teaches that, to obtain a polypropylene fiber of high strength using a mixture of iPP and sPP it is necessary to strictly limit the composition in certain respects : (1) the ratio of intrinsic viscosity of each of the two kinds of polypropylene must be within a specified range; (2) the sPP must have a syndiotactic pentad fraction of 0.7 or above and be present at a concentration of at least 50 parts by weight; and (3) correspondingly, the iPP concentration cannot exceed 50 parts by weight. The reference teaches that iPP is "a little inferior in fiber strength" so that improvement in this regard is desired and the advance which achieves the desired result is the use of at least 50 parts or more by weight of sPP in a composition containing sPP and iPP. As stated by Tadashi, if the amount of an isotactic polypropylene is more than 50 parts by weight, the strength of the resulting fiber will be insufficient."(col.3, lines 46–49). However, Tadashi fails to recognize that other useful fiber properties can be obtained using compositions in which the sPP content is less than 50 parts by weight or in which the iPP is the predominant polymer component; however Tadashi does not mention any improvement based on the presence of sPP for the bulk of the fiber.

Another specific disclosure of the use of sPP in fiber application appears in EP 634505. Said patent application teaches that amount of 5–50% wt sPP in sPP-iPP blend, can improve the shrinkage properties mainly in carpeting application. In this patent application either, there is no suggestion for the improvement of the bulk of the fiber.

Unfortunately, the problem of the increase of the bulk of the fiber is definitively not solved by the addition of large amount of SEBS, and is not suggested by the addition of amounts of sPP to the traditional iPP.

SUMMARY OF THE INVENTION

An object of the invention is to remedy this drawback.

Another object of the invention is to improve the bulk and the smoothness of the fiber.

Still another object of the invention is to lower the thermalbonding temperature of the fiber.

Still another object of the invention is to produce nonwovens exhibiting an improved "Hand" softness.

DETAILED DESCRIPTION OF THE INVENTION

The Applicants have unexpectedly found that by blending from 0.3 to 3% by weight of sPP, based on the total PP, to form a blend iPP-sPP, we can achieve all the objects of the present invention. Said PP blend preferably comprises from 1 to 3% by weight of sPP.

We have noted that amounts of sPP higher than 3% by weight may be blended with iPP but without reaching the best results as those obtained with the range disclosed in the invention. We have even observed no improvement at all of the bulk properties of the fiber when amounts of about 10% by weight were used.

The synthetic polymer resin formed by the polymerization of propylene as the sole monomer is called polypropylene. The well-known crystalline polypropylene of commerce is a normally solid, predominantly isotactic, semi-crystalline, thermoplastic homopolymer formed by the polymerization of propylene by Ziegler-Natta catalysis. In such catalytic polymerization the catalyst is formed by an organic compound of a metal of Groups I–III of the Periodic Table, (for example, an aluminum alkyl), and a compound of a transition metal of Groups IV–VIII of the Periodic Table, (for example, a titanium halide). A typical crystallinity is about 60% as measured by X-ray diffraction. As used herein, semi-crystalline means a crystallinity of at least about 5–10% as measured by X-ray diffraction. Also, the typical weight average molecular weight (Mw) of the normally solid polypropylene of commerce is 100,000–4,000,000 while the typical number average molecular weight (Mn) thereof is 40,000–100,000. Moreover, the melting point of the normally solid polypropylene of commerce is from about 159°–169° C., for example 162° C.

Syndiotactic polypropylene differs from isotactic polypropylene in that it is produced using a different and newly developed family of catalysts based on metallocene and usually aluminoxane as cocatalyst; suitable catalysts are described in the literature for producing sPP. Useful sPP should be "highly" syndiotactic. One means of characterizing such a property is by reference to the pentad fraction as defined by A. Zambelli et al. in Macromolecules, Vol. 6, 925 (1973) and ibid. Vol. 8, 687 (1975) using $^{13}$C-NMR. The syndiotactic pentad fraction of polymers useful herein should be 0.7 or higher, e.g., 0.8. Suitable catalyst systems are described in EP 0 414 147 (Tadashi et al.), supra, as well as in the Fina Technology and Canich references, all of which are incorporated by reference. An example of the catalyst system which can be used for the preparation of sPP useful in the present invention is disclosed in EP 0 414 047 as comprising a transition metal compound having an asymmetric ligand and an aluminoxane, attributed (J. Am. Chem. Soc., 1988, 110, 6255–6256). An example of the preferred catalyst system for the production of syndiotactic polypropylene comprises a transition metal compound and an aluminoxane. The transition metal compound includes isopropyl (cyclopentadienyl-1-fluorenyl) hafnium dihalogen, isopropyl(cyclopentadienyl-1-fluorenyl)-zirconium dihalogen, and those transition metal compounds in which at least one of the halogen atoms is replaced by an alkyl group. Generic compounds are represented by the following formula wherein R is a hydrocarbon residue of 1–3 carbon atoms:

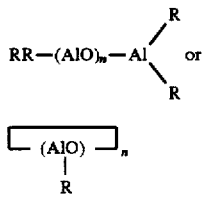

The compounds in which R is a methyl group, i.e., methylaluminoxane, and n is 5 or more, preferably 10 or more, are 20 particularly useful. The proportion of the aluminoxane used is 10 to 1,000,000 mole times, usually 50 to 5,000 mole times based on the foregoing transition metal compound. There are no particular restrictions on the polymerization process, so that a solution process utilizing inert solvents, a bulk polymerization process in the substantial absence of inert solvents and a gas phase polymerization process may be used. It is common to conduct the polymerization at a temperature of −100° to 200° C. and a pressure of atmospheric to 100 kg/cm$^2$G. Temperatures of −100° to 100° C. and pressures of atmospheric to 50 kg/cm$^2$G are preferred.

Preferably, the sPP used in the present invention has a molecular weight distribution of about 2 to 5, more preferably of about 3 to 5, the most preferably of about 4. Additionally, sPP is reported to be available commercially from Fina, Inc., Dallas, Texas and Mitsui Toatsu Chemicals, Japan. As used herein propylene polymer material means syndiotactic propylene polymer having a syndiotactic pentad fraction of 0.7 or more, and crystalline isotactic propylene polymer, each propylene polymer material selected from the group consisting of : (I) homopolymers of propylene; and (II) random crystalline propylene copolymers, terpolymers or both, consisting essentially of from about 80 to about 98.5% of propylene; preferable about 90 to about 95%, more preferably about 92 to about 94% of propylene; and from about 1.5 to about 20.0% of at least one comonomer selected from the group consisting of ethylene and $C_4$–$C_8$ alpha-olefins. When a $C_4$–$C_8$ alpha-olefin is not present, the copolymer preferably contains from about 2 to about 10% ethylene, more preferably from about 7 to about 9%. When a $C_4$–$C_8$ alpha-olefin is present, the terpolymer preferably contains from about 0.5 to about 5%, more preferably about 1 to about 3% ethylene and from about 2.5 to about 10.0%, preferably about 3 to about 7%, more preferably about 4.0 to about 6.0% of an olefin selected from the group consisting of $C_4$–$C_8$ alpha-olefins. Included also are mixtures of such copolymers and terpolymers.

EXAMPLE 1

A syndiotactic propylene homopolymer (sPP) having a pentad fraction greater than 0.7 is blended with crystalline isotactic homopolymer polypropylene (iPP) at concentrations of 3 parts sPP and 97 parts iPP to prepare fibers and nonwovens. The sPP has an MFR, as polymerized, of 4.5. The iPP is a commercially available product with a Melt Flow Rate (MFR)=25.

The process to make nonwovens from the polymer compositions includes the steps of:

1. Spinning—molten polymer composition is made into filaments.
2. Attenuation : the filaments are air stretched and cooled.
3. Thermalbonding : the laid fibers are consolidated into a web of 18 g/m$^2$, by calender bonding with a desirable embossing roll pattern.

One extruder is operated for the production of filaments. The extruder is operated at a pressure of 120 bar, at extrusion temperatures (°C.) of 200, 210, 220, 230, and 235 in the respective five zones. The stretching air is set at pressure of 3000 mm $H_2O$. Filaments of 2 to 8 dtex are produced.

Blend compositions are prepared using two methods : (1) preblending pellets of each component and pelletizing the mixture for subsequent extrusion to produce filaments; and (2) blending of pellets of each component at the filament extrusion stage; the methods produce substantially equivalent results. Preblending is conveniently accomplished using a Henschel blender followed by extrusion of strands at about 200°–220° C. and chopping of the strands into pellets.

Produced nonwovens from the blends result in acceptable nonwovens properties including tenacity (N) and elongation (%). The bulkiness of the produced nonwovens showed improvements as demonstrated by the "black box" text. Also, the covering power was markedly improved as evidenced by a sieve test. The results are shown in the Table below.

The "black box" test is a subjective test by which several persons feel the softness of the nonwovens placed in a "black box"; the average notation on a scale from 0 (minimum) to 10 (maximum) is reported.

The sieve test consists in using the nonwoven samples as sieves using a powder of constant granulometry. The percentage of powder retained in the sieve after 2 minutes is reported. This test is used for comparing nonwoven samples.

EXAMPLE 2

A syndiotactic propylene homopolymer (sPP) having a pentad fraction greater than 0.7 is blended with crystalline isotactic homopolymer polypropylene (iPP) at concentrations of 2 parts sPP and 98 parts iPP to prepare fibers and nonwovens. The sPP has an MFR, as polymerized, of 4.5. The iPP is a commercially available product with a Melt Flow Rate (MFR)=35.

The process to make nonwovens from the polymer compositions includes the steps of:

1. Spinning—molten polymer composition is made into filaments.
2. Drawing—filaments are stretched.

3. Texturizing—filaments are folded and optionally lightly air entangled to add bulk.

4. Cutting and baling.

5. Carding and laying.

6. Thermalbonding : the carded fibers are consolidated into a web of 20 g/m$^2$, by calender bonding with a desirable embossing roll pattern.

One extruder is operated for the production of filaments. The extruder is operated at a pressure of 120 bar, at extrusion temperatures (°C.) of 210, 225, 245, 260, 265, 265, and 275 in the respective seven zones. The quenching air is set at 20° C. Staple fibers of 2.2 dtex are produced.

Blend compositions are prepared using two methods : (1) preblending pellets of each component and pelletizing the mixture for subsequent extrusion to produce filaments; and (2) blending of pellets of each component at the filament extrusion stage; the methods produce substantially equivalent results. Preblending is conveniently accomplished using a Henschel blender followed by extrusion of strands at about 200°–220° C. and chopping of the strands into pellets.

Produced fibers from the blends result in acceptable fibers properties including denier, tenacity (g/denier) and elongation. Nonwovens produced with the compositions of the inventions are tested. The fiber smoothness and the "Hand" softness of the nonwovens was markedly improved as demonstrated by the "black box" and sieve tests (see Table).

TABLE

| | <-example 1-> | | <-example 2-> | |
|---|---|---|---|---|
| | ref. | mod. | ref. | mod. |
| Nonwoven weight g/m$^2$ | 20 | 20.7 | 16.7 | 16.9 |
| Fibre titre dtex | 2.2 | 2.2 | 1.6 | 1.8 |
| Tenacity CD N | 7.6 | 7.7 | 27.2 | 31.1 |
| Tenacity MD N | 36.9 | 38.9 | 32.8 | 28.9 |
| Elongation CD % | 106 | 144 | 61 | 63 |
| Elongation MD % | 65 | 87 | 39 | 48 |
| Sieve test % | 99.3 | 99.8 | 98.4 | 99.1 |
| Black box test/10 | 4 | 6 | 6.5 | 8 |

Notes:
ref. = reference i.e. comparison using pure iPP
mod. = modified i.e. according to the example
CD = cross-direction
MD = machine direction

We claim:

1. Polypropylene fiber comprising from 0.3 to 3% by weight of sPP and from 99.7 to 97% by weight of iPP.

2. Polypropylene fiber according to claim 1 comprising from 1 to 3% by weight of sPP.

3. Polypropylene fiber according to claim 1 wherein the sPP has a molecular weight distribution of about 2 to 5.

4. Polypropylene fiber according to claim 3 wherein the sPP has a molecular weight distribution of about 3 to 5.

5. Polypropylene fiber according to claim 4 wherein the sPP has a molecular weight distribution of about 4.

* * * * *